US012735813B2

(12) United States Patent
Yomo et al.

(10) Patent No.: US 12,735,813 B2
(45) Date of Patent: Sep. 15, 2026

(54) CARBON FIBER BUNDLE CONTAINING SIZING AGENT AND METHOD FOR PRODUCING SAME

(71) Applicant: TORAY INDUSTRIES, INC., Tokyo (JP)

(72) Inventors: Takayuki Yomo, Iyo-gun (JP); Misato Takenaka, Iyo-gun (JP); Haruki Okuda, Iyo-gun (JP)

(73) Assignee: TORAY INDUSTRIES, INC., Tokyo (JP)

( * ) Notice: Subject to any disclaimer, the term of this patent is extended or adjusted under 35 U.S.C. 154(b) by 361 days.

(21) Appl. No.: 18/576,225

(22) PCT Filed: Jul. 11, 2022

(86) PCT No.: PCT/JP2022/027196
§ 371 (c)(1),
(2) Date: Jan. 3, 2024

(87) PCT Pub. No.: WO2023/002876
PCT Pub. Date: Jan. 26, 2023

(65) Prior Publication Data

US 2024/0328038 A1 Oct. 3, 2024

(30) Foreign Application Priority Data

Jul. 19, 2021 (JP) ..... 2021-118452

(51) Int. Cl.
*D01F 9/12* (2006.01)
*D01F 11/14* (2006.01)
*D01F 11/16* (2006.01)

(52) U.S. Cl.
CPC ..... *D01F 9/12* (2013.01); *D01F 11/14* (2013.01); *D01F 11/16* (2013.01); *D10B 2101/12* (2013.01)

(58) Field of Classification Search
None
See application file for complete search history.

(56) References Cited

U.S. PATENT DOCUMENTS

2012/0276383 A1* 11/2012 Hirano ..... C08G 18/6674 428/368
2016/0369071 A1 12/2016 Ohtani et al.
2021/0309820 A1 10/2021 Kaneta et al.

FOREIGN PATENT DOCUMENTS

JP 11-116295 A 4/1999
WO WO 2011/089929 A1 7/2011
WO WO 2015/133569 A1 9/2015
WO WO 2020/138139 A1 7/2020

OTHER PUBLICATIONS

International Search Report, issued in PCT/JP2022/027196, PCT/ISA/210, dated Oct. 11, 2022.
Written Opinion of the International Searching Authority, issued in PCT/JP2022/027196, PCT/ISA/237, dated Oct. 11, 2022.

* cited by examiner

*Primary Examiner* — Arti Singh-Pandey
(74) *Attorney, Agent, or Firm* — Birch, Stewart, Kolasch & Birch, LLP

(57) ABSTRACT

A carbon fiber bundle containing a sizing agent particularly suitable for combination with a thermoplastic resin is provided, wherein the sizing agent has an appropriate level of bundling property for ease of handling and is susceptible to thermal degradation at temperatures low enough to maintain the surface properties of the carbon fibers, and wherein the residual amount of sizing agent can be reduced after the carbon fiber bundle is processed into an intermediate substrate, resulting in a reflection of the surface properties of the carbon fibers.

7 Claims, No Drawings

CARBON FIBER BUNDLE CONTAINING SIZING AGENT AND METHOD FOR PRODUCING SAME

TECHNICAL FIELD

The present invention relates to a sizing agent-containing carbon fiber bundle and a method of producing the same.

BACKGROUND ART

Carbon fiber is light in weight and high in strength and modulus of elasticity, and composites based on the combination of carbon fiber and one of various matrix resins are used in many areas, including, for example, aircraft parts, spacecraft parts, automobile parts, marine parts, construction materials, and sports goods. A representative form of composite using carbon fiber is a molded product made by compression molding of a preform obtained by stacking multiple prepreg layers (in the molding process, pressure is applied to the preform to remove air and press a shape). In a commonly used process, the prepreg is made by impregnating a carbon fiber substrate comprising unidirectionally aligned continuous carbon fiber bundles with a resin. Although some composites made of discontinuous (such as chopped or webbed) carbon fibers have been proposed as composites that have a high ability to conform to complex shapes and can be molded in a short time, prepregs are superior to these composites as structural materials in practical performance, including mechanical properties such as specific strength and specific toughness, and stability of properties.

Recently, carbon fiber-reinforced composites have been required to have excellent moldability, to allow easy handling, to achieve high mechanical properties in articles molded therefrom, and also to have higher economic and productive efficiency from an industrial point of view. One of the solutions to these requirements is the development of a prepreg using a thermoplastic resin as the matrix resin. Examples of production methods include a method comprising passing a thermoplastic resin slurry containing a powdered thermoplastic resin dispersed with a surfactant through a carbon fiber tape to produce a carbon fiber tape carrying a powdered thermoplastic resin, and applying heat and pressure to impregnate the carbon fiber tape with the thermoplastic resin.

Importantly, carbon fibers should be easy to handle during processing, with low fuzzing and breakage due to fuzzing, to take advantage of the excellent properties of carbon fiber after composite processing. Carbon fiber bundles that are not coated with a sizing agent have no bundling tendency and generate a large amount of fuzz, which can cause fuzz accumulation during prepreg production and degrade prepreg quality. Therefore, to provide easy handling of carbon fibers, a method of applying a sizing agent to a carbon fiber bundle is usually implemented to provide an abrasion-resistant coating on the carbon fiber surface (see Patent Literature 1 and Patent Literature 2).

If a sizing agent applied to carbon fibers is susceptible to thermal degradation, the sizing agent will decompose or volatilize when heated to high temperatures during formation of a carbon fiber-reinforced composite using a prepreg impregnated with a high molding temperature matrix resin, such as a super engineering plastic material, which can reduce the amount of gases in the matrix resin and result in a reduced void volume in a molded product (see Patent Literature 3).

Additionally, in a typical process, carbon fibers are oxidized by gas-phase oxidation, liquid-phase oxidation, or the like to introduce oxygen-containing functional groups, such as carboxyl and aldehyde groups, to the surface of the carbon fibers prior to impregnation with a matrix resin, thereby increasing the adhesion between the carbon fibers and the matrix resin (see Patent Literature 4).

CITATION LIST

Patent Literature

Patent Literature 1: U.S. Pat. No. 3,957,716
Patent Literature 2: JP-S57-171767A
Patent Literature 3: WO2020/0138139
Patent Literature 4: JP-H04-361619A

SUMMARY OF INVENTION

Technical Problem

On the other hand, in cases where a sizing agent is removed from the surface of carbon fibers by heat treatment as described above, a high temperature for thermal degradation may be required depending on the type of sizing agent. Such high temperatures sometimes caused degradation of oxygen-containing functional groups on the carbon fiber surface, which are necessary to reflect the physical properties of carbon fibers on the matrix resin, resulting in carbon fibers with a surface different from the original.

That is, although studies have been conducted on the application of a sizing agent to prevent fuzzing of carbon fibers and on thermally degradable sizing agents, no one has come up with an idea with respect to processing of carbon fibers impregnated with a thermally degradable sizing agent, wherein the application of a sizing agent to carbon fibers prevents fuzzing from occurring in carbon fiber bundles due to breakage of individual fibers, and the sizing agent is degraded at a temperature at which the carbon fibers can maintain the same surface condition as before the sizing agent was applied, so that the condition of the carbon fibers, which retain many surface functional groups, is reflected in a carbon fiber-reinforced composite.

The present invention has been made in view of the above, and an object of the present invention is to provide a carbon fiber bundle containing a sizing agent and a method of producing the same, wherein the sizing agent on the carbon fiber bundle is highly thermally degradable, although the sizing agent allows easy handling of the sizing agent-containing carbon fiber bundle, resulting in functional groups remaining on the carbon fiber surface and a reduced amount of sizing agent, and wherein the sizing agent-containing carbon fiber bundle is suitable for producing a prepreg comprising a high-heat resistant thermoplastic resin as a matrix resin, from which a carbon fiber-reinforced composite having very few residual voids and reflecting the surface properties of the carbon fibers is obtained.

Solution to Problem

The present invention to solve the problems described above is a carbon fiber bundle comprising carbon fibers and a sizing agent that satisfies all of the following requirements (i) to (iv):

(i) the sizing agent satisfies the requirement (a) or (b):

(a) the percentage by mass of a polyalkylene glycol structure in the total sizing agent is not less than 60% by mass;

(b) the sizing agent has an acetylene structure and the percentage by mass of the polyalkylene glycol structure in the total sizing agent is not less than 20% by mass;

(ii) the thermal weight loss ratio A determined under the following measurement conditions is not more than 5.0%;

(iii) the thermal weight loss ratio B determined under the following measurement conditions is not less than 11.0%;

(iv) the thermal weight loss ratio C determined under the following measurement conditions is not less than 90.0%:

<Thermal Weight Loss Ratio A> the sizing agent weighing 10±2 mg (the weighed mass is represented by $W_{A0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 140° C., and the measured mass is represented by $W_{A1}$ (mg), and the thermal weight loss ratio A is calculated by the following formula (A):

$$\text{thermal weight loss ratio } A(\%) = \{(W_{A0} - W_{A1})/W_{A0}\} \times 100; \quad \text{(A)}$$

<Thermal Weight Loss Ratio B> the sizing agent weighing 10±2 mg (the weighed mass is represented by $W_{B0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 250° C., and the measured mass is represented by $W_{B1}$ (mg), and the thermal weight loss ratio B is calculated by the following formula (B):

$$\text{thermal weight loss ratio } B(\%) = \{(W_{B0} - W_{B1})/W_{B0}\} \times 100; \quad \text{(B)}$$

<Thermal Weight Loss Ratio C> the sizing agent weighing 10±2 mg (the weighed mass is represented by $W_{C0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 350° C., and the measured mass is represented by $W_{C1}$ (mg), and the thermal weight loss ratio C is calculated by the following formula (C):

$$\text{thermal weight loss ratio } C(\%) = \{(W_{C0} - W_{C1})/W_{C0}\} \times 100. \quad \text{(C)}$$

In addition, a method of producing the sizing agent-containing carbon fiber bundle according to the present invention is characterized by comprises the steps of: applying a sizing agent to carbon fibers; and then drying the carbon fiber bundle with the applied sizing agent.

Advantageous Effects of Invention

The present invention can provide a carbon fiber bundle containing a sizing agent particularly suitable for combination with a thermoplastic resin, wherein the sizing agent applied to the carbon fibers is readily degraded by heat at low temperatures due to the good thermal degradability thereof, although the sizing agent allows easy handling of the sizing agent-containing carbon fiber bundle, resulting in carbon fiber-reinforced composites with very few residual voids and a reflection of the surface properties of the carbon fibers.

DESCRIPTION OF EMBODIMENTS

Embodiments of the present invention are described below. A sizing agent-containing carbon fiber bundle according to the present invention is a carbon fiber bundle comprising carbon fibers and a sizing agent that satisfies all of the following requirements (i) to (iv):

(i) the sizing agent satisfies the requirement (a) or (b):

(a) the percentage by mass of a polyalkylene glycol structure in the total sizing agent is not less than 60% by mass:

(b) the sizing agent has an acetylene structure and the percentage by mass of the polyalkylene glycol structure in the total sizing agent is not less than 20% by mass;

(ii) the thermal weight loss ratio A determined under the following measurement conditions is not more than 5.0%;

(iii) the thermal weight loss ratio B determined under the following measurement conditions is not less than 11.0%;

(iv) the thermal weight loss ratio C determined under the following measurement conditions is not less than 90.0%:

<Thermal Weight Loss Ratio A> the sizing agent weighing 10±2 mg (the weighed mass is represented by $W_{A0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 140° C. (the measured mass is represented by $W_{A1}$ (mg)), and the thermal weight loss ratio A is calculated by the following formula (A):

$$\text{thermal weight loss ratio } A(\%) = \{(W_{A0} - W_{A1})/W_{A0}\} \times 100; \quad \text{(A)}$$

<Thermal Weight Loss Ratio B> the sizing agent weighing 10±2 mg (the weighed mass is represented by $W_{B0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 250° C. (the measured mass is represented by $W_{B1}$ (mg)), and the thermal weight loss ratio B is calculated by the following formula (B):

$$\text{thermal weight loss ratio } B(\%) = \{(W_{B0} - W_{B1})/W_{B0}\} \times 100; \quad \text{(B)}$$

<Thermal Weight Loss Ratio C> the sizing agent weighing 10±2 mg (the weighed mass is represented by $W_{C0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 350° C. (the measured mass is represented by $W_{C1}$ (mg)), and the thermal weight loss ratio C is calculated by the following formula (C):

$$\text{thermal weight loss ratio } C(\%) = \{(W_{C0} - W_{C1})/W_{C0}\} \times 100. \quad \text{(C)}$$

The inventors' study revealed problems with the use of a sizing agent applied to improve the handling of carbon fibers, including a problem of reduced thermal degradability of the sizing agent on the sizing agent-containing carbon fiber bundle, which leaves a greater amount of sizing agent and increases void formation during prepreg production, and a problem of not reflecting the surface properties of the original carbon fibers in the carbon fiber bundle when heated at high temperature to promote thermal degradation. The inventors have studied to solve these problems and found that even if a sizing agent capable of providing easy handling is used, both easy handling of a carbon fiber bundle containing the sizing agent and good low-temperature thermal degradability of the sizing agent can be achieved by regulating the proportion of the alkylene glycol structure in the total sizing agent, or by incorporating an acetylene structure and regulating the proportion of the alkylene glycol structure in the total sizing agent, to control the thermal degradability of the sizing agent.

The sizing agent constituting the present invention is required to satisfy the requirement (a) or (b):

(a) the percentage by mass of a polyalkylene glycol structure in the total sizing agent is not less than 60% by mass;

(b) the sizing agent has an acetylene structure and the percentage by mass of the polyalkylene glycol structure in the total sizing agent is not less than 20% by mass.

The polyalkylene glycol structure is a structure represented by the general formula (1) below:

$$-[CH_2-CH(R)-O]_n- \qquad \text{General Formula (1).}$$

In the general formula (1), R represents a hydrogen atom or a methyl group, and n is an integer of 2 to 20.

A carbon fiber bundle containing a sizing agent having a polyalkylene glycol structure at a controlled ratio shows high thermal degradability and no reaction with the carbon fiber surface during thermal degradation. As a result, the amount of sizing agent remaining on the carbon fiber bundle is reduced and the original surface condition of the carbon fibers is easily maintained. In the formula (1), R represents a hydrogen atom or a methyl group and is preferably a hydrogen atom with respect to the solubility in water. The letter n represents an integer of 2 to 20; the smaller the integer within the above range, the more preferable it is. The letter n is more preferably an integer of not more than 5, and even more preferably an integer of not more than 3, from the viewpoint of reducing the molecular weight and thereby improving the thermal degradability. When n is an integer of not less than 21, the resulting sizing agent has a high molecular weight and low thermal degradability.

Examples of the sizing agent having the structure represented by the general formula (1) include polyethylene glycol, acetylene glycol, polyoxyethylene alkyl ether such as polyoxyethylene dodecyl ether, polyoxyethylene oleyl ether, or polyoxyethylene stearyl ether, propylene glycol, polyoxyethylene polyoxypropylene glycol, and polyoxyethylene alkylphenyl ether. These sizing agents may be used individually, or two or more of these sizing agents may be used in combination.

The acetylene structure is a structure having a carbon-carbon triple bond. Examples of the sizing agent having an acetylene structure include acetylene alcohols and acetylene glycol.

The sizing agents listed above may be used individually or in a blend containing two or more of the sizing agents.

With respect to the requirement (a), the percentage by mass of a polyalkylene glycol structure in the total sizing agent is preferably not less than 80% by mass, and more preferably 85% by mass. The higher the mass percentage of a polyalkylene glycol structure, the better the sizing agent. In cases where the percentage of a polyalkylene glycol structure is less than 60% by mass of the total sizing agent, the probability of the sizing agent contacting with carbon fibers is so low that the sizing agent is unlikely to react with the functional groups on the carbon fiber surface, resulting in increased heat resistance and reduced thermal degradation.

Just for clarification, the percentage of a polyalkylene glycol structure in the sizing agent is about 83% by mass ((106−18)/106×100 (Note: the decimal portion of the atomic weight of each atom is eliminated)) when the sizing agent comprises only diethylene glycol ($HO(CH_2CH_2O)_2H$), and the percentage of a polyalkylene glycol structure in the sizing agent is about 88% by mass ((150−18)/150×100 (Note: the decimal portion of the atomic weight of each atom is eliminated)) when the sizing agent comprises only triethylene glycol ($HO(CH_2CH_2O)_3H$).

With respect to the requirement (b), the percentage by mass of a polyalkylene glycol structure in the total sizing agent is required to be not less than 20% by mass when the sizing agent has an acetylene structure. In cases where the sizing agent has an acetylene structure, the compound takes a more linear conformation due to the triple bond in the acetylene structure, and the linear conformation reduces the interaction through entanglement. Therefore, high thermal degradability is achieved when the percentage of a polyalkylene glycol structure is not less than 20% by mass. In cases where the percentage of a polyalkylene glycol structure is less than 20% by mass, the resulting increased percentage of an acetylene structure increases the heat resistance of the sizing agent, resulting in reduced thermal degradability of the sizing agent. More preferably, in cases where the sizing agent has an acetylene structure, the percentage by mass of a polyalkylene glycol structure in the total sizing agent is not less than 50% by mass.

Just for clarification, the percentage of an acetylene structure is about 21% by mass (24/114×100 (Note: the decimal portion of the atomic weight of each atom is eliminated)) when the sizing agent comprises only bis(1-hydroxyethyl)acetylene ($CH_3CH(OH)CCCH(OH)CH_3$).

In cases where the structural formula of the sizing agent applied to carbon fibers is known, the percentages of a polyalkylene glycol structure and an acetylene structure in the total sizing agent can be calculated from the structural formula of the sizing agent. In cases where the structural formula of the sizing agent is unknown, a known technique such as proton NMR, carbon NMR, mass spectrometry, or TOF-SIMS can be applied to the sizing agent extracted from a sizing agent-containing carbon fiber bundle to identify the structure of the sizing agent and to calculate the percentages of a polyalkylene glycol structure and an acetylene structure in the total sizing agent from the identified structure. In cases where the sizing agent is a combination of multiple components, the components are separated using a column for evaluation. An example of extraction conditions is described below.

<Extraction Conditions>

A sizing agent-containing carbon fiber bundle weighing 1 g is added to 100 mL of a solution of chloroform and methanol mixed in a ratio of 1:1, and then treated by ultrasonic irradiation for 30 minutes, and the resulting mixture is left overnight. The resulting extract is collected and evaporated to dryness. The mass percentage of the extract to the sizing agent-containing carbon fiber bundle is calculated and it is determined if the resulting mass percentage agrees with the measured amount of sizing agent in the carbon fiber bundle within a 10% margin of error. In cases where the results do not agree even after repeating the extraction several times, such sizing agent-containing carbon fiber bundle will be excluded from the scope of the present invention.

And now, if the sizing agent applied to the carbon fiber bundle contains epoxy, amino, and/or oxazoline groups as a structure other than a polyalkylene glycol structure, the epoxy, amino, and/or oxazoline groups will react with the functional groups on the carbon fiber surface, resulting in increased heat resistance and reduced thermal degradability of the sizing agent. Thus, the sizing agent containing epoxy, amino, and/or oxazoline groups is preferably in an amount of not more than 30% by mass of the total sizing agent, and more preferably is substantially free of such sizing agent. The term "substantially free" refers to a level of less than 1% by mass, where the mass of the sizing agent is considered to be 100%.

In cases where the structural formula of the sizing agent on the carbon fiber bundle is known, whether or not the sizing agent containing epoxy, amino, and/or oxazoline groups can be found and the amount of it is calculated from the structural formula of the sizing agent. In cases where the structural formula of the sizing agent is unknown, a known technique such as proton NMR, carbon NMR, mass spectrometry, or TOF-SIMS can be applied to the sizing agent extracted from a sizing agent-containing carbon fiber bundle to identify the structure of the sizing agent and to calculate the percentage of a sizing agent containing epoxy, amino, and/or oxazoline groups from the identified structure. In cases where the sizing agent is a combination of multiple components, the components can be separated using a column for evaluation in an additional step to identify the structure of each component and to calculate the percentage of a sizing agent containing epoxy, amino, and/or oxazoline groups from the identified structure.

In the sizing agent constituting the present invention, the thermal weight loss ratio A determined under the following measurement conditions should be 5.0% or less.

<Conditions for Measuring Thermal Weight Loss Ratio A>

The sizing agent weighing 10±2 mg (the weighed mass is represented by $W_{A0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 140° C. (the measured mass is represented by $W_{A1}$ (mg)), and the thermal weight loss ratio A is calculated by the following formula (A):

$$\text{thermal weight loss ratio } A\,(\%) = \{(W_{A0} - W_{A1})/W_{A0}\} \times 100. \quad \text{(A)}$$

When the thermal weight loss ratio A is 5.0% or less, the sizing agent can be prevented from thermally degrading or evaporating while the sizing agent is applied to untreated carbon fibers, thereby providing a sizing agent-containing carbon fiber bundle, wherein the carbon fiber bundle is less likely to fuzz up when exposed to mechanical friction during spreading or the like, and is excellent in ease of handling.

If the thermal weight loss ratio A is greater than 5.0%, it indicates that the sizing agent contains an abundant amount of a component that increases the thermal weight loss ratio A. Such a component that increases the thermal weight loss ratio A has a low molecular weight and low adhesion strength to carbon fibers. Accordingly, a higher thermal weight loss ratio A indicates that the sizing agent is less able to adhere to the carbon fibers and the resulting sizing agent-containing carbon fiber bundle is poor in ease of handling.

The thermal weight loss ratio A is preferably not more than 3.0%, more preferably not more than 1.0%, and especially preferably 0%. The lower the thermal weight loss ratio A, the better the sizing agent. That is, the lower limit of the thermal weight loss ratio A is preferably 0%.

In the sizing agent constituting the present invention, the thermal weight loss ratio B determined under the following measurement conditions should be 11.0% or more.

<Thermal Weight Loss Ratio B>

The sizing agent weighing 10±2 mg (the weighed mass is represented by $W_{B0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 250° C. (the measured mass is represented by $W_{B1}$ (mg)), and the thermal weight loss ratio B is calculated by the following formula (B):

$$\text{thermal weight loss ratio } B\,(\%) = \{(W_{B0} - W_{B1})/W_{B0}\} \times 100. \quad \text{(B)}$$

When the thermal weight loss ratio B is 11.0% or more, most of the gas generation from thermal degradation or evaporation of the sizing agent will be completed while a carbon fiber bundle containing the sizing agent is heated at low temperature, resulting in the sizing agent being removed from the resulting carbon fiber-reinforced composite. The result is a high-quality molded product (carbon fiber-reinforced composite) with very few residual voids and a reflection of the surface properties of the original carbon fibers.

If the thermal weight loss ratio B is less than 11.0%, it indicates that the sizing agent contains an abundant amount of a component that decreases the thermal weight loss ratio B. Such a component that decreases the thermal weight loss ratio B has a high molecular weight and easily spreads over the carbon fiber surface. Accordingly, a lower thermal weight loss ratio B indicates that the surface of the resulting sizing agent-containing carbon fiber bundle is more easily changed to a surface different from that of the original carbon fibers by heat treatment.

The thermal weight loss ratio B is preferably not less than 30.0%, more preferably not less than 60.0%, even more preferably not less than 90.0%, and particularly preferably 100.0%. The higher the thermal weight loss ratio B, the better the sizing agent. That is, the upper limit of the thermal weight loss ratio B is preferably 100.0%.

In the sizing agent constituting the present invention, the thermal weight loss ratio C determined under the following measurement conditions should be 90.0% or more.

<Thermal Weight Loss Ratio C>

The sizing agent weighing 10±2 mg (the weighed mass is represented by $W_{C0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 350° C. (the measured mass is represented by $W_{C1}$ (mg)), and the thermal weight loss ratio C is calculated by the following formula (C):

$$\text{thermal weight loss ratio } C\,(\%) = \{(W_{C0} - W_{C1})/W_{C0}\} \times 100. \quad \text{(C)}$$

When the thermal weight loss ratio C is 90.0% or more, most of the gas generation from degradation or evaporation of the sizing agent will be completed when heating of a carbon fiber bundle containing the sizing agent is completed, resulting in the sizing agent being removed from the resulting carbon fiber-reinforced composite. The result is a high-quality carbon fiber-reinforced composite with very few residual voids.

If the thermal weight loss ratio C is less than 90.0%, it indicates that the sizing agent contains an abundant amount of a component that decreases the thermal weight loss ratio C. Such a component that decreases the thermal weight loss ratio C is highly heat resistant in the air and easily turns into a residue on the carbon fiber surface. Accordingly, a lower thermal weight loss ratio C indicates that the surface of the resulting sizing agent-containing carbon fiber bundle is more easily changed to a surface different from that of the original carbon fibers by heat treatment.

The thermal weight loss ratio C is preferably not less than 90.0%, more preferably not less than 95.0%, even more preferably not less than 99.0%, and particularly preferably 100.0%. The higher the thermal weight loss ratio C, the better the sizing agent. That is, the upper limit of the thermal weight loss ratio C is preferably 100.0%.

The thermal weight loss ratio A, thermal weight loss ratio B, and thermal weight loss ratio C can be controlled by changing the elements or moieties in the sizing agent or altering the number-average molecular weight Mn, which is described below in this specification.

It should be noted that with respect to the thermal weight loss ratio A, thermal weight loss ratio B, and thermal weight loss ratio C, the ratios determined by evaluating the sizing agent are not different from those determined by evaluating the sizing agent extracted under the extraction conditions described below from a carbon fiber bundle containing the sizing agent.

<Extraction Conditions>

A sizing agent-containing carbon fiber bundle weighing 1 g is added to 100 mL of a solution of chloroform and methanol mixed in a ratio of 1:1, and then treated by ultrasonic irradiation for 30 minutes, and the resulting mixture is left overnight. The resulting extract is collected and evaporated to dryness. The mass percentage of the extract to the sizing agent-containing carbon fiber bundle is calculated and it is determined if the resulting mass percentage agrees with the measured amount of sizing agent in the carbon fiber bundle within a 10% margin of error.

The sizing agent constituting the present invention preferably has a number-average molecular weight Mn of not less than 120 and less than 300. The number-average molecular weight Mn is measured by gel permeation chromatography (hereinafter abbreviated as GPC) using polystyrene standards. When the Mn is less than 300, the sizing agent has a shorter molecular chain and higher thermal degradability, so that the sizing agent can be thermally degraded in a shorter time at a lower temperature. The Mn is more preferably not more than 250, and even more preferably not more than 200. In contrast, when the Mn is not less than 120, the sizing agent can be prevented from evaporating or thermally degrading while applied to untreated carbon fibers. The Mn is more preferably not less than 135.

The number-average molecular weight Mn of a sizing agent on a carbon fiber bundle containing the sizing agent can be determined by extracting the sizing agent from the sizing agent-containing carbon fiber bundle by the extraction method described above and evaluating the sizing agent by GPC.

<Method for Measuring Number-Average Molecular Weight Mn>

The number-average molecular weight of a sizing agent can be measured by a known technique using GPC and polystyrene standards. In the present invention, the following conditions are used as conditions for GPC measurement:

- Measuring instrument: a device manufactured by Shimadzu Corporation
- Column used: TSKgel HXL-L+TSKgel α-3000 columns manufactured by TOSOH BIOSCIENCE
- Eluent: 0.01 mol/L solution of lithium bromide in dimethylformamide
- Standard: polystyrene (manufactured by TOSOH Corporation)
- Detector: differential refractometer (manufactured by Shimadzu Corporation).

In cases where the sizing agent constituting the present invention is a mixture of multiple components, the value obtained by measuring the mixture is determined as the number-average molecular weight Mn.

Preferably, the sizing agent used in the present invention is substantially free of an aromatic ring. Structures containing an aromatic ring(s), such as bisphenol A and benzene, are highly heat resistant, and the presence of an aromatic ring in a sizing agent reduces the thermal degradability of the sizing agent. The term "substantially free" refers to a level of less than 1% by mass, where the mass of the sizing agent is considered to be 100%.

In cases where the structural formula of the sizing agent on the sizing agent-containing carbon fiber bundle is known, the percentage of an aromatic ring(s) in the sizing agent can be determined from the structural formula of the sizing agent. In cases where the structural formula of the sizing agent is unknown, a known technique such as proton NMR, carbon NMR, mass spectrometry, or TOF-SIMS can be applied to the sizing agent extracted from a sizing agent-containing carbon fiber bundle to identify the structure of the sizing agent and to calculate the percentage of an aromatic ring(s). In cases where the sizing agent is a combination of multiple components, the components can be separated using a column for evaluation in an additional step to identify the structure of each component and to calculate the percentage of an aromatic ring(s) from the identified structure.

The sizing agent content of the sizing agent-containing carbon fiber bundle of the present invention is preferably not less than 0.3% by mass and not more than 1.2% by mass, the mass of the sizing agent-containing carbon fiber bundle being taken as 100%. In cases where a carbon fiber bundle comprises multiple sizing agents, the sum of the sizing agent contents is determined as the sizing agent content of the carbon fiber bundle.

When the sizing agent content is not less than 0.3% by mass, the sizing agent provides easier handling and prevents the sizing agent-containing carbon fiber bundle from fuzzing during manufacturing or processing, and a carbon fiber sheet made from the carbon fiber bundle can have higher qualities, such as smoothness. The amount of deposited sizing agent is more preferably not less than 0.4% by mass, and even more preferably not less than 0.5% by mass. In contrast, when the sizing agent content is not more than 1.2% by mass, the sizing agent remaining on the carbon fiber bundle can be reduced in a short time at a low temperature, thus reducing the influence on the matrix resin. The sizing agent content is more preferably not more than 1.0% by mass, and even more preferably not more than 0.8% by mass.

Preferably, when the sizing agent-containing carbon fiber bundle of the present invention is heated at 250° C. in an oxidizing atmosphere for 20 seconds and the fiber surface is then analyzed by X-ray photoelectron spectroscopy at 45° photoelectron takeoff angle using AlKα as the X-ray source, the ratio of the detected photoelectron intensity (b) (cps) at an energy of 286.1 eV (C—O) to the detected photoelectron intensity (a) (cps) at a binding energy of 284.6 eV (C—C) in the $C_{1S}$ core level spectrum (photoelectron intensity (b)/photoelectron intensity (a)) is not less than 0.2 and not more than 0.8.

Hereinafter, the ratio of the detected photoelectron intensity (b) (cps) at an energy of 286.1 eV (C—O) to the detected photoelectron intensity (a) (cps) at a binding energy of 284.6 eV (C—C) in the $C_{1S}$ core level spectrum measured for the fiber surface by X-ray photoelectron spectroscopy at 45° photoelectron takeoff angle using AlKα as the X-ray source is sometimes referred to as "the photoelectron intensity ratio (b)/(a)" or simply referred to as "the photoelectron intensity ratio".

Since carbon atoms are surrounded by different types of neighboring atoms with different bonding states on the carbon fiber surface, the $C_{1S}$ core level spectrum measured for the carbon fiber surface by X-ray photoelectron spectroscopy is produced as a composite peak composed of sub-peaks with different binding energies. The binding energy of 284.6 eV in the $C_{1S}$ core level spectrum is located in the middle of the range that includes the sub-peaks corresponding to different bonding states: C—H, C—C, and C=C. In contrast, the binding energy of 286.1 eV in the $C_{1S}$ core level spectrum is located in the middle of the range that includes a sub-peak corresponding to a bonding state: C—O. Therefore, the ratio of the detected photoelectron intensity (b) (cps) at a binding energy of 286.1 eV to the detected photoelectron intensity (a) (cps) at a binding energy of 284.6 eV, the photoelectron intensity ratio (b)/(a), represents the percentage of carbon atoms with C—O bonds on the carbon fiber surface, and a smaller photoelectron intensity ratio (b)/(a) means a smaller percentage of carbon atoms with C—O bonds.

Preferably, in the present invention, the photoelectron intensity ratio (b)/(a) on the carbon fiber surface is not more than 0.8, at which the amount of a sizing agent remaining on the carbon fiber surface via C—O bonds is significantly reduced. The smaller the photoelectron intensity ratio (b)/(a), the closer the properties of the carbon fiber surface after heat treatment to those of the carbon fiber surface before application of a sizing agent. Therefore, the surface properties of the original carbon fibers can be reflected on the matrix resin. In particular, the photoelectron intensity ratio (b)/(a) is more preferably not more than 0.5. When the photoelectron intensity ratio (b)/(a) is not less than 0.2, the original functional groups remain intact on the carbon fiber surface, resulting in surface physical properties reflected on the matrix resin. In particular, the photoelectron intensity ratio (b)/(a) is more preferably not less than 0.3.

In the context of heating, an oxidizing atmosphere is an atmosphere containing a high proportion of an oxidizing gas (oxygen, ozone, or the like), and air is preferred because of its ease of handling.

Heating of a sizing agent-containing carbon fiber bundle at 250° C. for 20 seconds can be accomplished by the following procedures. A sizing agent-containing carbon fiber bundle is passed through rollers into a heated air atmosphere to thermally degrade the sizing agent: a sizing agent-containing carbon fiber bundle set for unwinding is passed through a heating furnace via free rollers both in front of and behind the heating furnace and wound in a winder process. The unwinding tension applied to the sizing agent-containing carbon fiber bundle during unwinding from a creel is set to 800 g, and the process speed is set to 6 m/min, and the length of the heating section at 250° C. in the heating furnace is set to 2 m, so that the heating time reaches 20 seconds. The heated sizing agent-containing carbon fiber bundle is analyzed by XPS to measure the photoelectron intensity ratio (b)/(a) on the carbon fiber surface and the sizing agent content in the carbon fiber bundle, which determines the sizing agent content after heat treatment.

In the sizing agent-containing carbon fiber bundle according to the present invention, the sizing agent content is changed to a percentage of not less than 0.02% by mass and not more than 0.1% by mass when the sizing agent-containing carbon fiber bundle is heated at 250° C. for 20 seconds in an oxidizing atmosphere. In cases where a carbon fiber bundle comprises multiple sizing agents, the sum of the sizing agent contents is determined as the sizing agent content of the carbon fiber bundle.

When the sizing agent content is not more than 0.1% by mass after heating at 250° C. for 20 seconds in an oxidizing atmosphere, most of the gas generation from thermal degradation or evaporation of the sizing agent is complete, resulting in the removal of the sizing agent from a carbon fiber-reinforced composite. The result is a high-quality molded product (carbon fiber-reinforced composite) with very few residual voids and a reflection of the surface properties of the original carbon fibers. In particular, the sizing agent content after heating at 250° C. for 20 seconds in an oxidizing atmosphere is more preferably less than 0.08% by mass, even more preferably less than 0.06% by mass, and particularly preferably not more than 0.04% by mass.

The sizing agent content of not less than 0.02% by mass after heating at 250° C. for 20 seconds in an oxidizing atmosphere is preferred because the original functional groups remain intact on the carbon fiber surface.

In the present invention, although the amount of oxygen atoms on the carbon fiber surface before application of a sizing agent is not specifically limited, the oxygen concentration (functional group amount, O/C) on the carbon fiber surface is not less than 0.11 and not more than 0.25, more preferably not less than 0.15 and not more than 0.20, as measured by X-ray photoelectron spectroscopy with respect to the mechanical properties of carbon fiber-reinforced composites obtained therefrom. If the amount of functional groups on the carbon fiber surface is too low, the carbon fibers tend to have very low adhesion to a matrix resin. On the other hand, if the amount of functional groups on the carbon fibers is too high, the amount of functional groups before and after processing into a carbon fiber-reinforced composite will vary greatly because functional groups are easily degraded during processing involving heating, resulting in a tendency for the properties of the original carbon fibers to be less reflected in the carbon fiber-reinforced composite.

The carbon fibers used in the present invention, before application of a sizing agent, preferably have a bundle-bundle friction coefficient of not less than 0.25 and not more than 0.43. When the bundle-bundle friction coefficient is not less than 0.25, frictional force easily acts between individual fibers, which in turn easily improves the bundling tendency. The bundle-bundle friction coefficient is more preferably not less than 0.28, and even more preferably not less than 0.30. When the bundle-bundle friction coefficient is not more than 0.43, the frictional force between individual fibers in a resulting carbon fiber bundle is reduced, which reduces fuzzing caused by friction when the carbon fiber bundle is pulled from a bobbin. The bundle-bundle friction coefficient is more preferably not more than 0.39, and even more preferably not more than 0.35. The bundle-bundle friction coefficient can be controlled by the surface roughness of the carbon fibers, the type and intensity of surface treatment, and the like.

Next, the components used in the present invention for the sizing agent-containing carbon fiber bundle are described.

Although the carbon fibers used in the present invention are not limited to a specific type of carbon fiber, polyacrylonitrile-based carbon fibers are suitable for use from the viewpoint of mechanical properties. A polyacrylonitrile-based carbon fiber bundle used in the present invention is produced by subjecting polyacrylonitrile copolymer-based precursor fibers for carbon fibers to a flameproofing treatment at a highest temperature of 200 to 300° C. in an oxidizing atmosphere, and then to a pre-carbonizing treatment at a highest temperature of 500 to 1200° C. in an inert atmosphere, and then to a carbonizing treatment at a highest temperature of 1200 to 2000° C. in an inert atmosphere.

Preferably, in the present invention, the adhesion of carbon fiber bundles to a matrix resin is increased by subjecting the carbon fiber bundles to an oxidation treatment to introduce oxygen-containing functional groups to the surface of the carbon fiber bundles. As an oxidation technique, gas-phase oxidation, liquid-phase oxidation, or liquid-phase electrolytic oxidation can be used, and liquid-phase electrolytic oxidation is suitable for use because of the ability of liquid-phase electrolytic oxidation to achieve high productivity and uniform treatment.

In the present invention, an electrolyte used in liquid-phase electrolytic oxidation is an acidic electrolyte or an alkaline electrolyte. Examples of the acidic electrolyte include inorganic acids, such as sulfuric acid, nitric acid, hydrochloric acid, phosphoric acid, boric acid, and carbonic acid; organic acids, such as acetic acid, butyric acid, oxalic acid, acrylic acid, and maleic acid; and salts, such as ammonium sulfate and ammonium hydrogen sulfate. Among these electrolytes, sulfuric acid and nitric acid, which are strong acids, are preferred for use. Specific examples of the alkaline electrolyte include aqueous solutions of hydroxides, such as sodium hydroxide, potassium hydroxide, magnesium hydroxide, calcium hydroxide, and barium hydroxide; aqueous solutions of carbonates, such as sodium carbonate, potassium carbonate, magnesium carbonate, calcium carbonate, barium carbonate, and ammonium carbonate; aqueous solutions of bicarbonates, such as sodium bicarbonate, potassium bicarbonate, magnesium bicarbonate, calcium bicarbonate, barium bicarbonate, and ammonium bicarbonate; and aqueous solutions of ammonia, tetraalkylammonium hydroxide, and hydrazine.

Next, a method of producing a sizing agent-containing carbon fiber bundle according to the present invention is described.

A technique for infiltrating (applying) a sizing agent constituting the present invention into (to) carbon fibers is first described.

Preferably, in the present invention, the sizing agent is diluted with a solvent and the resulting dilution is used as a homogeneous solution. Examples of the solvent include water, methanol, ethanol, 2-propanol, acetone, methyl ethyl ketone, dimethylformamide, and dimethylacetamide. Among these solvents, water is preferred for use because of its advantages in terms of ease of handling and safety.

Techniques for applying a sizing agent include, for example, a technique in which a carbon fiber bundle is dipped into a sizing agent solution via rollers, a technique in which a carbon fiber bundle is brought into contact with a sizing agent solution on a roller, and a technique in which a sizing agent solution is sprayed over a carbon fiber bundle, and the technique of dipping carbon fibers into a sizing agent solution via rollers is preferably used to produce a sizing agent-containing carbon fiber bundle according to the present invention. The application of a sizing agent may be either batch or continuous, but a continuous application technique is preferred for use because of the ability to achieve high productivity and to reduce variation. In addition, another preferred aspect is to add vibration to carbon fibers during the application of a sizing agent.

Preferably, in the present invention, the sizing agent solution is dried after being applied to a carbon fiber bundle with a contact-type drying means, for example, by contacting the carbon fiber bundle with heated rollers to obtain a sizing agent-containing carbon fiber bundle. When transferred to a heated roller, the carbon fiber bundle is pressed against the heated roller with tensile force and dried in a short time, and the shape of the carbon fiber bundle flattened and widened by the heated roller is easily maintained by the sizing agent. In the flattened carbon fiber bundle, the contact area between individual fibers is reduced and the contact area between individual fibers and a gas is increased, so that the sizing agent tends to be thermally degraded at a higher efficiency. Also in the present invention, the passage through the heated roller as a preliminary drying process may be followed by a further heat treatment as a second drying process. A non-contact type of heating is a preferred type of heat treatment as a second drying process due to the ease of heating at high temperatures. The heat treatment can further remove the diluent solvent remaining in the sizing agent and keep the viscosity of the sizing agent stable, which contributes to a stable increase in leachability. The drying temperature is preferably in the range of 110 to 140° C. A drying temperature of 110° C. or higher can reduce the water content of the sizing agent and tends to increase the thermal degradability of the sizing agent. A drying temperature of 120° C. or higher is more preferred. On the other hand, a drying temperature of up to 140° C. can prevent partial evaporation of the sizing agent, which helps to maintain ease of handling. A drying temperature of 135° C. or lower is more preferred.

Additionally, the heat treatment can be performed by irradiation with microwave and/or infrared light.

EXAMPLES

The present invention is specifically described by examples below. However, the present invention is not limited to the examples given and the description of the examples should not be construed as limiting the invention.

<Method for Measuring Sizing Agent Content in Carbon Fiber Bundle and Pyrolysis Rate of Carbon Fibers>

A sizing agent-containing carbon fiber bundle was weighed in the range of 2.0±0.5 g ($W_1$ (g)) (weighing to four decimal places), and then placed in an electric heating furnace (volume: 120 $cm^3$) at 450° C. for 15 minutes under a nitrogen flow of 50 milliliters/min to complete thermal degradation of the sizing agent. Subsequently, the carbon fiber bundle was transferred to a container under a dry nitrogen flow of 20 liters/min, cooled for 15 minutes, and then weighed ($W_2$ (g)) (weighing to four decimal places) to calculate the mass of the sizing agent by the formula: $W_1$-$W_2$. The mass of the sizing agent was converted to a percentage by mass to the mass of the sizing agent-containing carbon fiber bundle, which is taken as 100% by mass, and the resulting value (rounded to two decimal places) was determined as the sizing agent content (% by mass). The measurement was repeated twice, and the average of the measurements was used as the sizing agent content. In cases where carbon fibers are free of a sizing agent, the value obtained from the measurement described above represents the carbon fiber pyrolysis rate.

In the present invention, the sizing agent content in a carbon fiber bundle was evaluated in four grades according to the following criteria in terms of preferred percentage ranges after heating at 250° C. for 20 seconds in an oxidizing atmosphere:

A: a sizing agent content of not less than 0.02% by mass and less than 0.06% by mass;

B: a sizing agent content of not less than 0.06% by mass and less than 0.08% by mass;

C: a sizing agent content of not less than 0.08% by mass and not more than 0.10% by mass;

D: a sizing agent content of less than 0.02% by mass or more than 0.10% by mass.

<Surface Oxygen Concentration in Carbon Fiber (O/C)>

The surface oxygen concentration of carbon fiber (O/C) was measured by X-ray photoelectron spectroscopy according to the following procedure. Carbon fibers were first cut into 20 mm lengths, spread over a copper sample tray, and then analyzed by X-ray photoelectron spectroscopy at 45° C. photoelectron takeoff angle using AlK$\alpha_{1,2}$ as the X-ray source while maintaining the pressure in the sample chamber at $1\times10^{-8}$ Torr. A binding energy of 285 eV was set as the binding energy value of the main $C_{1s}$ peak, corrected for electrical charging during the analysis. A straight baseline was drawn between 275 eV and 290 eV on the binding energy axis to calculate the $C_{1S}$ peak area. A straight baseline was drawn between 525 eV and 540 eV on the binding energy axis to calculate the $O_{1s}$ peak area. An X-ray photoelectron spectroscope ESCA-1600 manufactured by ULVAC-PHI, Incorporated was used.

<Photoelectron Intensity Ratio (b)/(a) on Carbon Fiber Surface>

The photoelectron intensity ratio (b)/(a) on the carbon fiber surface was determined from the $C_{1S}$ core level spectrum obtained by the procedure described above according to the following procedure. The straight baseline from 282 eV to 292 eV used to determine the $C_{1S}$ peak area was defined as a starting line to measure photoelectron intensities, and the ratio (b)/(a) was calculated from the detected photoelectron intensity (a) (cps: photoelectron count per second) at a binding energy of 284.6 eV and the detected photoelectron intensity (b) (cps) at a binding energy of 286.1 eV.

In the present invention, the similarity to the original surface condition of the carbon fibers was evaluated in four grades according to the following criteria in terms of preferred ranges of photoelectron intensity ratio:

A: a photoelectron intensity ratio (b)/(a) of not less than 0.3 and not more than 0.5;

B: a photoelectron intensity ratio (b)/(a) of more than 0.5 and not more than 0.6;

C: a photoelectron intensity ratio (b)/(a) of not less than 0.2 and less than 0.3, or more than 0.6 and not more than 0.8;

D: a photoelectron intensity ratio (b)/(a) of less than 0.2 or more than 0.8.

<Method of Measuring Bundle-Bundle Friction Coefficient>

The bundle-bundle friction coefficient was determined by the following procedure. A sizing agent-containing carbon fiber bundle was wound onto a bobbin, which was secured not to rotate, to a thickness of 5 to 10 mm and a wrapping density of 0.9 to 1.4 g/$cm^3$, and another carbon fiber bundle of the same type was wrapped around the surface of the carbon fiber roll to form a contact angle of 3π (rad), but not on the circumference. A weight (T1=0.25 g/tex) was attached to an end of the carbon fiber wrap, and the other end of the carbon fiber wrap was pulled at a speed of 1 m/min by a spring scale. The bundle-bundle friction coefficient was calculated from the following formula, where T2 (g/tex) is the tension measured when the carbon fiber wrap started to move. The measurement was repeated twice, and the average of the measurements was used as the bundle-bundle friction coefficient. The bobbin used in this measurement was placed under the atmospheric conditions of temperature and humidity (measurement conditions: 23±3° C./60±5%) for 2 hours or longer before use.

$$\text{Bundle-bundle friction coefficient} = \ln(T2/T1)/\theta$$

$T2$: tension measured when a carbon fiber bundle starts to move $T1$: mass of a weight ( = 0.25 g/*tex*)

$\theta$: total contact angle between a wrapped fiber bundle and a wrapping fiber bundle ( = 3π rad).

<Method of Measuring Abrasion-Created Fuzzy CF>

Four metal bars (made of stainless steel SUS304) having a diameter of 20 mm and a surface roughness R max (JIS B 0601 (1982)) of 0.3 μm were arranged in a pattern in which the metal bars were spaced 150 mm apart and alternately positioned in the vertical direction so that a carbon fiber bundle could pass between the metal bars and contact with the metal bars at a total angle of 1.57π (rad). A carbon fiber bundle was then mounted between the metal bars and pulled at a speed of 6 m/min by a rotating roller with the unwinding tension from a supply package set to 500 g. The fiber bundle passing through the fourth metal bar was horizontally irradiated with a perpendicular laser beam to measure the fuzz count with a fuzz detector for 1 minute, and the measured fuzz count was recorded. In the present invention, the ease of handling was evaluated in three grades according to the following criteria in terms of preferred fuzz count ranges, where a carbon fiber bundle with a grade of A or B was acceptable and a carbon fiber bundle with a grade of C was unacceptable:

A: a fuzz count of less than 4 per meter;

B: a fuzz count of not less than 4 per meter and less than 8 per meter;

C: a fuzz count of not less than 8 per meter.

The materials and components used in examples and comparative examples are as described below.

Components (A):

A-1: triethylene glycol
(molecular weight: 150, manufactured by FUJIFILM Wako Pure Chemical Corporation)

A-2: polyethylene glycol
(molecular weight: 200, PEG-200, manufactured by Sanyo Chemical Industries, Ltd.)

A-3: acetylene glycol surfactant
(molecular weight: 290, "SURFYNOL" (registered trademark) 440, manufactured by Nissin Chemical Industry Co., Ltd.)

A-4: polyethylene glycol
(molecular weight: 300, PEG-300, manufactured by Sanyo Chemical Industries, Ltd.)

A-5: polypropylene glycol
(molecular weight: 400, NEWPOL GP-400, manufactured by Sanyo Chemical Industries, Ltd.)

A-6: diethylene glycol
(molecular weight: 106, manufactured by FUJIFILM Wako Pure Chemical Corporation)

A-7: polyethylene glycol
(molecular weight: 600, PEG-600, manufactured by Sanyo Chemical Industries, Ltd.)

A-8: polypropylene glycol
(molecular weight: 600, PPG-600, manufactured by Sanyo Chemical Industries, Ltd.)

A-9: acetylene glycol surfactant
(molecular weight: 466, "SURFYNOL" (registered trademark) 465, manufactured by Nissin Chemical Industry Co., Ltd.)

A-10: bisphenol A-ethylene oxide adduct
(molecular weight: 490, NEWPOL BPE-60, manufactured by Sanyo Chemical Industries, Ltd.)

A-11: glycerol polyglycidyl ether
(molecular weight: 400, "DENACOL" (registered trademark) Ex-313, manufactured by Nagase ChemteX Corporation)

A-12: 4-tert-butylphenyl glycidyl ether
(molecular weight: 206, manufactured by Tokyo Chemical Industry Co., Ltd.)

A-13: polyethyleneimine
(molecular weight: 800, "Lupasol" (registered trademark) FG, manufactured by BASF Japan Ltd.).

Reference examples are first described. Each reference example is produced in the following two steps.

Reference Example 1

Step of Raw Material Carbon Fiber Production

An acrylonitrile copolymer was spun and carbonized into carbon fibers, from which a carbon fiber bundle having a total filament number of 12,000, a total fineness of 800 tex, a strand tensile strength of 5.1 GPa, and a strand tensile modulus of 240 GPa was obtained. Next, the fiber surface was electrochemically treated by applying 80 coulombs of electricity per one gram of carbon fiber bundle using an aqueous solution of ammonium bicarbonate as the electrolyte. The electrochemically treated carbon fibers surfaces were then washed with water and dried in heated air at 150° C. to remove the water, resulting in carbon fibers as raw material. The carbon fiber pyrolysis rate, surface oxygen concentration, photoelectron intensity ratio on the surface of the carbon fiber bundle, and bundle-bundle friction coefficient were measured for the carbon fibers obtained in the first step. The result of the measurements was as follows: the carbon fiber bundle had a carbon fiber pyrolysis rate of 0.05% by mass; the surface oxygen concentration of the carbon fiber was 0.18; the photoelectron intensity ratio on the surface of the carbon fiber bundle was 0.4; and the bundle-bundle friction coefficient was 0.42.

Evaluation of the sizing agent content in a carbon fiber bundle and the surface condition of carbon fibers after heat treatment The carbon fibers obtained in the previous step were heated at 250° C. for 20 seconds by the method described elsewhere herein, and the carbon fiber pyrolysis rate and the photoelectron intensity ratio on the surface of the carbon fiber bundle were measured in the resulting carbon fibers.

The result showed that the values measured for the carbon fiber bundle after heat treatment were very close to those measured for the carbon fiber bundle before heat treatment: the carbon fiber pyrolysis rate was 0.04% by mass; and the photoelectron intensity ratio was 0.4. The above-described results are summarized in Table 1.

TABLE 1

| | Unit | Ref. Ex. 1 | Ref. Ex. 2 | Ref. Ex. 3 | Ref. Ex. 4 |
|---|---|---|---|---|---|
| Surface oxygen concentration of the carbon fiber | — | 0.18 | 0.18 | 0.05 | 0.05 |
| Bundle-bundle friction coefficient of carbon fibers | — | 0.42 | 0.42 | 0.23 | 0.23 |
| First component (A) | — | — | — | — | — |
| Second component (A) | — | — | — | — | — |
| Percentage of a polyalkylene glycol structure | % by mass | — | — | — | — |
| Percentage of an acetylene structure | % by mass | — | — | — | — |
| Thermal weight loss ratio A | % | — | — | — | — |
| Thermal weight loss ratio B | % | — | — | — | — |
| Thermal weight loss ratio C | % | — | — | — | — |

TABLE 1-continued

| | Unit | Ref. Ex. 1 | Ref. Ex. 2 | Ref. Ex. 3 | Ref. Ex. 4 |
|---|---|---|---|---|---|
| Number-average molecular weight Mn of a sizing agent | — | — | — | — | — |
| Percentage of aromatic rings in a sizing agent | % by mass | — | — | — | — |
| Drying temperature of carbon fibers | ° C. | — | — | — | — |
| Pyrolysis rate of carbon fibers before heat treatment | % by mass | 0.05 | 0.05 | 0.02 | 0.02 |
| Photoelectron intensity ratio (b)/(a) on the carbon fiber surface before heat treatment | — | 0.4 | 0.4 | 0.2 | 0.2 |
| Heat treatment temperature | ° C. | 250 | 400 | 250 | 400 |
| Heat treatment time | sec | 20 | 20 | 20 | 20 |
| Pyrolysis rate of carbon fibers after heat treatment | % by mass | 0.04 | 0.01 | 0.01 | 0.01 |
| Photoelectron intensity ratio (b)/(a) on the carbon fiber surface after beat treatment | — | A (0.4) | D (0.1) | C (0.2) | D (0) |
| Abrasion-created fuzzy CF | count/m | — | — | — | — |

Ref. Ex.: Reference Example

Reference Example 2

Heated carbon fibers were obtained and evaluated for the various evaluation parameters in the same manner as in Reference Example 1, except that the heat treatment temperature was changed to 400° C. to evaluate the sizing agent content in the carbon fiber bundle and the surface condition of the carbon fibers after heat treatment. The result was as shown in Table 1, showing a reduced photoelectron intensity ratio on the surface of the carbon fiber bundle.

Reference Example 3

Carbon fibers were obtained and evaluated for the various evaluation parameters in the same manner as in Reference Example 1, except that the amount of electricity applied to the fiber surface for electrochemical treatment was changed to 10 coulombs per one gram of carbon fiber in the above step of raw material carbon fiber production. The result was as shown in Table 1, showing that the values measured for the carbon fiber bundle after heat treatment were very close to those measured for the carbon fiber bundle before heat treatment. However, the amount of functional groups on the carbon fibers was originally low.

Reference Example 4

Carbon fibers were obtained and evaluated for the various evaluation parameters in the same manner as in Reference Example 1, except that the amount of electricity applied to the fiber surface for electrochemical treatment was changed to 10 coulombs per one gram of carbon fiber in the above step of raw material carbon fiber production, and the heat treatment temperature was changed to 400° C. to evaluate the sizing agent content in the carbon fiber bundle and the surface condition of the carbon fibers after heat treatment. The result was as shown in Table 1, showing that the values measured for the carbon fiber bundle after heat treatment were very close to those measured for the carbon fiber bundle before heat treatment. However, the amount of functional groups on the carbon fibers was originally low.

Next, Example 1 is described below. Example 1 is exemplified in accordance with the following steps 1 to 4.

Example 1

First Step: Step of Raw Material Carbon Fiber Production

An acrylonitrile copolymer was spun and carbonized into carbon fibers, from which a carbon fiber bundle having a total filament number of 12,000, a total fineness of 800 tex, a strand tensile strength of 5.1 GPa, and a strand tensile modulus of 240 GPa was obtained. Next, the fiber surface was electrochemically treated by applying 80 coulombs of electricity per one gram of carbon fiber bundle using an aqueous solution of ammonium bicarbonate as the electrolyte. The electrochemically treated carbon fibers surfaces were then washed with water and dried in heated air at 150° C. to remove the water, resulting in carbon fibers as raw material. The surface oxygen concentration, photoelectron intensity ratio on the surface of the carbon fiber bundle, and bundle-bundle friction coefficient were measured for the carbon fibers obtained in the first step.

Second Step: Step of Carbon Fiber Impregnation with a Sizing Agent

Component (A-1) as a sizing agent was dissolved in water as shown in Table 2 to a concentration of about 1.5% by mass to obtain an aqueous solution. The aqueous solution was used as a sizing agent solution to impregnate the surface-treated carbon fiber bundle with the sizing agent by dipping. The resulting carbon fiber bundle was dried on a hot roller by heating at 120° C. for 5 seconds to obtain a sizing agent-containing carbon fiber bundle. The sizing agent content was adjusted to 0.7% by mass with respect to the total surface-treated sizing agent-containing carbon fiber bundle, which was considered to be 100% by mass. In addition, the measurement of the thermal weight loss ratio in the sizing agent by the following method showed a thermal weight loss ratio A of 4.8%, a thermal weight loss ratio B of 99.5%, and a thermal weight loss ratio C of 99.8%.

<Thermal Weight Loss Ratio A>

The sizing agent weighing 10±2 mg (the measured mass is represented by $W_{A1}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 140° C. (the measured mass is represented by $W_{A1}$ (mg)), and the thermal weight loss ratio A is calculated by the following formula (A):

$$\text{thermal weight loss ratio } A\,(\%) = \{(W_{A0} - W_{A1})/W_{A0}\} \times 100. \quad \text{(A)}$$

<Thermal Weight Loss Ratio B>

The sizing agent weighing 10±2 mg (the weighed mass is represented by $W_{B0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 250° C. (the measured mass is represented by $W_{B1}$ (mg)), and the thermal weight loss ratio B is calculated by the following formula (B):

$$\text{thermal weight loss ratio } B\,(\%) = \{(W_{B0} - W_{B1})/W_{B0}\} \times 100. \quad \text{(B)}$$

<Thermal Weight Loss Ratio C>

The sizing agent weighing 10±2 mg (the weighed mass is represented by $W_{C0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 350° C. (the measured mass is represented by $W_{C1}$ (mg)), and the thermal weight loss ratio C is calculated by the following formula (C):

$$\text{thermal weight loss ratio } C\,(\%) = \{(W_{C0} - W_{C1})/W_{C0}\} \times 100. \quad \text{(C)}$$

Third Step: Evaluation of the Ease of Handling of a Sizing Agent-Containing Carbon Fiber Bundle The carbon fiber bundle produced in the second step was used to evaluate the ease of handling based on the method for measuring abrasion-created fuzzy CFs. The result showed that the carbon fiber bundle was less likely to fuzz and was very easy to handle.

Fourth Step: Evaluation of the Sizing Agent Content and the Surface Condition of Carbon Fibers after Heat Treatment The sizing agent-containing carbon fiber bundle obtained in the previous step was thermally degraded by the burning-off method described elsewhere herein to obtain a sizing agent-containing carbon fiber bundle burned off at 250° C. for 20 seconds.

Subsequently, the sizing agent content and the photoelectron intensity ratio on the surface of the carbon fiber bundle were measured. The result of the measurements was as follows: the residual sizing agent content after heat treatment was as low as 0.04% by mass; the photoelectron intensity ratio was 0.4; the thermal degradability of the sizing agent was very high; and the surface condition of the carbon fibers was very close to the original shown in Reference Example 1.

The above-described results are summarized in Table 2.

TABLE 2

| | Unit | Ex. 1 | Ex 2 | Ex. 3 | Ex. 4 | Ex. 5 | Ex. 6 | Ex. 7 |
|---|---|---|---|---|---|---|---|---|
| Surface oxygen concentration of the carbon fiber | — | 0.18 | 0.18 | 0.18 | 0.18 | 0.18 | 0.18 | 0.18 |
| Bundle-bundle friction coefficient of carbon fibers | — | 0.42 | 0.42 | 0.42 | 0.42 | 0.42 | 0.42 | 0.42 |
| First component (A) | — | A-1 | A-1 | A-1 | A-2 | A-3 | A-4 | A-5 |
| Second component (A) | — | — | A-11 | A-12 | — | — | — | — |
| Percentage of a polyalkylene glycol structure | % by mass | 88 | 79 | 70 | 91 | 30 | 94 | 90 |
| Percentage of an acetylene structure | % by mass | 0 | 0 | 0 | 0 | 8 | 0 | 0 |
| Thermal weight loss ratio A | % | 4.8 | 4.8 | 4.8 | 3.0 | 2.2 | 1.9 | 1.5 |
| Thermal weight loss ratio B | % | 99.5 | 90.9 | 99.5 | 55.0 | 39.5 | 19.5 | 13.0 |
| Thermal weight loss ratio C | % | 99.8 | 93.2 | 99.5 | 99.6 | 99.1 | 99.5 | 99.6 |
| Number-average molecular weight Mn of a sizing agent | — | 150 | 175 | 160 | 200 | 290 | 300 | 400 |
| Percentage of aromatic rings in a sizing agent | % by mass | 0 | 0 | 0 | 0 | 0 | 0 | 0 |
| Drying temperature in the drying step | ° C. | 120 | 120 | 120 | 120 | 120 | 120 | 120 |
| Sizing agent content before heat treatment | % by mass | 0.7 | 0.7 | 0.7 | 0.7 | 0.7 | 0.7 | 0.7 |
| Heat treatment temperature | ° C. | 250 | 250 | 250 | 250 | 250 | 250 | 250 |
| Heat treatment time | sec | 20 | 20 | 20 | 20 | 20 | 20 | 20 |
| Sizing agent content after heat treatment | % by mass | A (0.04) | A (0.05) | A (0.04) | A (0.05) | A (0.05) | B (0.07) | B (0.07) |

TABLE 2-continued

| | Unit | Ex. 1 | Ex 2 | Ex. 3 | Ex. 4 | Ex. 5 | Ex. 6 | Ex. 7 |
|---|---|---|---|---|---|---|---|---|
| Photoelectron intensity ratio (b)/(a) on the carbon fiber surface after heat treatment | — | A (0.4) | C (0.8) | C (0.7) | B (0.6) | B (0.6) | C (0.8) | C (0.8) |
| Abrasion-created fuzzy CF | count/m | A (2) | A (2) | A (2) | A (2) | A (2) | A (2) | A (2) |

Ex.: Example

Example 2

A sizing agent-containing carbon fiber bundle was obtained and evaluated for the various evaluation parameters in the same manner as in Example 1, except that the sizing agent in the second step contained a mixture of 90% by mass Component (A-1) and 10% by mass Component (A-11). The result was as shown in Table 2: the carbon fiber bundle was very easy to handle; the thermal degradability of the sizing agent was very high; and the surface condition of the carbon fibers was sufficiently close to the original shown in Reference Example 1.

Example 3

A sizing agent-containing carbon fiber bundle was obtained and evaluated for the various evaluation parameters in the same manner as in Example 1, except that the sizing agent in the second step contained a mixture of 80% by mass Component (A-1) and 20% by mass Component (A-12). The result was as shown in Table 2: the carbon fiber bundle was very easy to handle; the thermal degradability of the sizing agent was very high; and the surface condition of the carbon fibers was sufficiently close to the original shown in Reference Example 1.

Example 4

A sizing agent-containing carbon fiber bundle was obtained and evaluated for the various evaluation parameters in the same manner as in Example 1, except that the sizing agent in the second step was changed to a sizing agent containing Component (A-2). The result was as shown in Table 2: the carbon fiber bundle was very easy to handle; the thermal degradability of the sizing agent was very high; and the surface condition of the carbon fibers was very close to the original shown in Reference Example 1.

Example 5

A sizing agent-containing carbon fiber bundle was obtained and evaluated for the various evaluation parameters in the same manner as in Example 1, except that the sizing agent in the second step was changed to a sizing agent containing Component (A-3). The result was as shown in Table 2: the carbon fiber bundle was very easy to handle; the thermal degradability of the sizing agent was very high; and the surface condition of the carbon fibers was very close to the original shown in Reference Example 1.

Example 6

A sizing agent-containing carbon fiber bundle was obtained and evaluated for the various evaluation parameters in the same manner as in Example 1, except that the sizing agent in the second step was changed to a sizing agent containing Component (A-4). The result was as shown in Table 2: the carbon fiber bundle was very easy to handle; the thermal degradability of the sizing agent was sufficiently high; and the surface condition of the carbon fibers was sufficiently close to the original shown in Reference Example 1.

Example 7

A sizing agent-containing carbon fiber bundle was obtained and evaluated for the various evaluation parameters in the same manner as in Example 1, except that the sizing agent in the second step was changed to a sizing agent containing Component (A-5). The result was as shown in Table 2: the carbon fiber bundle was very easy to handle; the thermal degradability of the sizing agent was sufficiently high; and the surface condition of the carbon fibers was sufficiently close to the original shown in Reference Example 1.

Example 8

A sizing agent-containing carbon fiber bundle was obtained and evaluated for the various evaluation parameters in the same manner as in Example 1, except that the sizing agent content in the second step was changed to 0.4% by mass. The result was as shown in Table 3: the carbon fiber bundle was very easy to handle; the thermal degradability of the sizing agent was very high and the surface condition of the carbon fibers was very close to the original shown in Reference Example 1.

TABLE 3

| | Unit | Ex. 8 | Ex. 9 | Ex. 10 | Ex. 11 | Ex. 12 | Ex. 13 | Ex. 14 | Ex. 15 |
|---|---|---|---|---|---|---|---|---|---|
| Surface oxygen concentration of the carbon fiber | — | 0.18 | 0.18 | 0.18 | 0.18 | 0.18 | 0.18 | 0.05 | 0.18 |
| Bundle-bundle friction coefficient of carbon fibers | — | 0.42 | 0.42 | 0.42 | 0.42 | 0.42 | 0.42 | 0.23 | 0.42 |
| First component (A) | — | A-1 | A-1 | A-2 | A-3 | A-4 | A-5 | A-1 | A-1 |

TABLE 3-continued

| | Unit | Ex. 8 | Ex. 9 | Ex. 10 | Ex. 11 | Ex. 12 | Ex. 13 | Ex. 14 | Ex. 15 |
|---|---|---|---|---|---|---|---|---|---|
| Second component (A) | — | — | — | — | — | — | — | — | A-10 |
| Percentage of a polyalkylene glycol structure | % by mass | 88 | 88 | 91 | 30 | 94 | 90 | 88 | 87 |
| Percentage of an acetylene structure | % by mass | 0 | 0 | 0 | 8 | 0 | 0 | 0 | 0 |
| Thermal weight loss ratio A | % | 4.8 | 4.8 | 3.0 | 2.2 | 1.9 | 1.5 | 4.8 | 4.7 |
| Thermal weight loss ratio B | % | 99.5 | 99.5 | 55.0 | 39.5 | 19.5 | 13.0 | 99.5 | 94.6 |
| Thermal weight loss ratio C | % | 99.8 | 99.8 | 99.6 | 99.1 | 99.5 | 99.6 | 99.8 | 95.3 |
| Number-average molecular weight Mn of a sizing agent | — | 150 | 150 | 200 | 290 | 300 | 400 | 150 | 185 |
| Percentage of aromatic rings in a sizing agent | % by mass | 0 | 0 | 0 | 0 | 0 | 0 | 0 | 3 |
| Drying temperature in the drying step | ° C. | 120 | 120 | 120 | 120 | 120 | 120 | 120 | 120 |
| Sizing agent content before heat treatment | % by mass | 0.4 | 0.2 | 0.2 | 0.2 | 0.2 | 0.2 | 0.7 | 0.7 |
| Heat treatment temperature | ° C. | 250 | 250 | 250 | 250 | 250 | 250 | 250 | 250 |
| Heat treatment time | sec | 20 | 20 | 20 | 20 | 20 | 20 | 20 | 20 |
| Sizing agent content after heat treatment | % by mass | A (0.04) | A (0.04) | A (0.04) | A (0.05) | B (0.06) | B (0.06) | A (0.02) | B (0.07) |
| Photoelectron intensity ratio (b)/(a) on the carbon fiber surface after heat treatment | — | A (0.4) | A (0.4) | A (0.5) | A (0.5) | C (0.7) | C (0.7) | C (0.2) | C (0.8) |
| Abrasion-created fuzzy CF | count/m | A (2) | B (4) | B (4) | B (4) | B (4) | B (4) | A (2) | A (2) |

Ex.: Example

Examples 9 to 11

Sizing agent-containing carbon fiber bundles were obtained and evaluated for the various evaluation parameters in the same manner as in Example 1, except that the sizing agent and the sizing agent content before heat treatment in the second step were changed as shown in Table 2. The results were as shown in Table 3: the carbon fiber bundles were easy enough to handle; the thermal degradability of the sizing agent was very high; and the surface condition of the carbon fibers was very close to the original shown in Reference Example 1.

Examples 12 and 13

Sizing agent-containing carbon fiber bundles were obtained and evaluated for the various evaluation parameters in the same manner as in Example 1, except that the sizing agent and the sizing agent content before heat treatment in the second step were changed as shown in Table 2. The results were as shown in Table 3: the carbon fiber bundles were easy enough to handle; the thermal degradability of the sizing agent was sufficiently high; and the surface condition of the carbon fibers was sufficiently close to the original shown in Reference Example 1.

Example 14

Carbon fibers were obtained and evaluated for the various evaluation parameters in the same manner as in Example 1, except that the amount of electricity applied to the fiber surface for electrochemical treatment was changed to 10 coulombs per one gram of carbon fiber in the first step. The result was as shown in Table 3: the carbon fiber bundle was easy enough to handle; the thermal degradability of the sizing agent was very high; the photoelectron intensity ratio (b)/(a) on the carbon fiber surface after heat treatment was low; and the surface condition of the carbon fibers was very close to the original shown in Reference Example 3.

Example 15

A sizing agent-containing carbon fiber bundle was obtained and evaluated for the various evaluation parameters in the same manner as in Example 1, except that the sizing agent in the second step contained a mixture of 90% by mass Component (A-1) as the first component and 10% by mass Component (A-10) as the second component. The result was as shown in Table 3: the carbon fiber bundle was very easy to handle; the thermal degradability of the sizing agent was sufficiently high; and the surface condition of the carbon fibers was sufficiently close to the original shown in Reference Example 1.

Comparative Example 1

A sizing agent-containing carbon fiber bundle was obtained and evaluated for the various evaluation parameters in the same manner as in Example 1, except that the sizing agent in the second step was changed to a sizing agent containing Component (A-6). The result was as shown in Table 4: the thermal weight loss ratio A was high; the sizing agent was evaporated so that the sizing agent was not deposited on the carbon fibers; and the carbon fiber bundle was difficult to handle.

TABLE 4

| | Unit | Cp. Ex. 1 | Cp. Ex. 2 | Cp. Ex. 3 | Cp. Ex. 4 | Cp. Ex. 5 | Cp. Ex. 6 | Cp. Ex. 7 | Cp. Ex. 8 | Cp. Ex. 9 | Cp. Ex. 10 |
|---|---|---|---|---|---|---|---|---|---|---|---|
| Surface oxygen concentration of the carbon fiber | — | 0.18 | 0.18 | 0.18 | 0.18 | 0.18 | 0.18 | 0.18 | 0.18 | 0.18 | 0.18 |
| Bundle-bundle friction coefficient of carbon fibers | — | 0.42 | 0.42 | 0.42 | 0.42 | 0.42 | 0.42 | 0.42 | 0.42 | 0.42 | 0.42 |
| First component (A) | — | A-6 | A-7 | A-8 | A-9 | A-10 | A-11 | A-13 | A-7 | A-1 | A-1 |
| Second component (A) | — | — | — | — | — | — | — | — | — | A-11 | A-12 |
| Percentage of a polyalkylene glycol structure | % by mass | 71 | 97 | 97 | 57 | 78 | 0 | 0 | 97 | 26 | 26 |
| Percentage of an acetylene structure | % by mass | 0 | 0 | 0 | 5 | 0 | 0 | 0 | 0 | 0 | 0 |
| Thermal weight loss ratio A | % | 10.0 | 3.9 | 0.6 | 0.4 | 0.5 | 2.0 | 4.9 | 3.9 | 4.9 | 4.8 |
| Thermal weight loss ratio B | % | 99.5 | 5.0 | 5.5 | 3.4 | 0.8 | 30.0 | 13.5 | 5.0 | 39.3 | 98.0 |
| Thermal weight loss ratio C | % | 99.8 | 23.0 | 97.1 | 88.0 | 10.0 | 79.0 | 34.0 | 23.0 | 53.7 | 99.0 |
| Number-average molecular weight Mn of a sizing agent | — | 106 | 600 | 600 | 466 | 490 | 400 | 700 | 600 | 350 | 195 |
| Percentage of aromatic rings in a sizing agent | % by mass | 0 | 0 | 0 | 0 | 15 | 0 | 0 | 0 | 0 | 0 |
| Drying temperature in the drying step | ° C. | 120 | 120 | 120 | 120 | 120 | 120 | 120 | 120 | 120 | 120 |
| Sizing agent content before heat treatment | % by mass | 0.05 | 0.7 | 0.7 | 0.6 | 0.6 | 0.6 | 0.6 | 0.7 | 0.7 | 0.7 |
| Heat treatment temperature | ° C. | — | 250 | 250 | 250 | 250 | 250 | 250 | 400 | 250 | 250 |
| Heat treatment time | sec | — | 20 | 20 | 20 | 20 | 20 | 20 | 20 | 20 | 20 |
| Sizing agent content after heat treatment | % by mass | — | D (0.6) | C (0.09) | D (0.5) | D (0.5) | D (0.5) | D (0.5) | A (0.02) | D (0.5) | B (0.07) |
| Photoelectron intensity ratio (b)/(a) on the carbon fiber surface after heat treatment | — | — | D (3.5) | D (1.4) | — | — | — | — | D (0.1) | D (2.1) | D (0.9) |
| Abrasion-created fuzzy CF | count/m | C (10) | A (2) | A (2) | A (2) | A (2) | A (2) | A (2) | A (2) | A (2) | A (2) |

Cp. Ex.: Comparative Example

Comparative Example 2

A sizing agent-containing carbon fiber bundle was obtained and evaluated for the various evaluation parameters in the same manner as in Example 1, except that the sizing agent in the second step was changed to a sizing agent containing Component (A-7). The result was as shown in Table 4: the carbon fiber bundle was very easy to handle; however, the thermal weight loss ratio B was low; the thermal degradability of the sizing agent was low; and the amount of sizing agent remaining on the carbon fiber surface even after heat treatment was so high that the analysis of the carbon fiber surface was not possible.

Comparative Example 3

A sizing agent-containing carbon fiber bundle was obtained and evaluated for the various evaluation parameters in the same manner as in Example 1, except that the sizing agent in the second step was changed to a sizing agent containing Component (A-8). The result was as shown in Table 4: the carbon fiber bundle was very easy to handle;

however, the thermal weight loss ratio B was low; the thermal degradability of the sizing agent was low; and the sizing agent remained on the carbon fiber surface even after heat treatment.

Comparative Example 4

A sizing agent-containing carbon fiber bundle was obtained and evaluated for the various evaluation parameters in the same manner as in Example 1, except that the sizing agent in the second step was changed to a sizing agent containing Component (A-9). The result was as shown in Table 4: the carbon fiber bundle was very easy to handle; however, the thermal weight loss ratios B and C were low; the thermal degradability of the sizing agent was low; and the amount of sizing agent remaining on the carbon fiber surface even after heat treatment was so high that the analysis of the carbon fiber surface was not possible.

Comparative Example 5

A sizing agent-containing carbon fiber bundle was obtained and evaluated for the various evaluation parameters in the same manner as in Example 1, except that the sizing agent in the second step was changed to a sizing agent containing Component (A-10). The result was as shown in Table 4: the carbon fiber bundle was very easy to handle; however, the thermal weight loss ratios B and C were low; the thermal degradability of the sizing agent was low; and the amount of sizing agent remaining on the carbon fiber surface even after heat treatment was so high that the analysis of the carbon fiber surface was not possible.

Comparative Example 6

A sizing agent-containing carbon fiber bundle was obtained and evaluated for the various evaluation parameters in the same manner as in Example 1, except that the sizing agent in the second step was changed to a sizing agent containing Component (A-11). The result was as shown in Table 4: the carbon fiber bundle was very easy to handle; however, the ratio of a component satisfying the formula (1) was less than 50% by mass; the thermal weight loss ratio C was low so that the thermal degradability of the sizing agent was low; and the sizing agent remained on the carbon fiber surface even after heat treatment.

Comparative Example 7

A sizing agent-containing carbon fiber bundle was obtained and evaluated for the various evaluation parameters in the same manner as in Example 1, except that the sizing agent in the second step was changed to a sizing agent containing Component (A-13). The result was as shown in Table 4: the carbon fiber bundle was very easy to handle; however, the ratio of a component satisfying the formula (1) was less than 50% by mass; the thermal weight loss ratio C was low so that the thermal degradability of the sizing agent was low; and the sizing agent remained on the carbon fiber surface even after heat treatment.

Comparative Example 8

A sizing agent-containing carbon fiber bundle was obtained and evaluated for the various evaluation parameters in the same manner as in Example 1, except that the sizing agent in the second step was changed to a sizing agent containing Component (A-7) and the heating temperature in the fourth step was changed to 400° C. The result was as shown in Table 4: the carbon fiber bundle was very easy to handle; no sizing agent was left on the carbon fiber bundle; however, the photoelectron intensity ratio (b)/(a) on the carbon fiber surface after heating was low; and even the surfaces of the original carbon fibers were degraded.

Comparative Example 9

A sizing agent-containing carbon fiber bundle was obtained and evaluated for the various evaluation parameters in the same manner as in Example 1, except that the sizing agent in the second step contained a mixture of 30% by mass Component (A-1) and 70% by mass Component (A-11). The result was as shown in Table 4: the carbon fiber bundle was very easy to handle; however, the thermal weight loss ratio C was low so that the thermal degradability of the sizing agent was low; and the sizing agent remained on the carbon fiber surface even after heat treatment.

Comparative Example 10

A sizing agent-containing carbon fiber bundle was obtained and evaluated for the various evaluation parameters in the same manner as in Example 1, except that the sizing agent in the second step contained a mixture of 30% by mass Component (A-1) and 70% by mass Component (A-12). The result was as shown in Table 4: the carbon fiber bundle was very easy to handle; no sizing agent was left on the carbon fiber bundle; however, the ratio of a component satisfying the formula (1) was less than 50% by mass so that the photoelectron intensity ratio (b)/(a) on the carbon fiber surface after heating was high; and the sizing agent remained on the carbon fiber surface even after heat treatment.

INDUSTRIAL APPLICABILITY

The present invention can provide a sizing agent-containing carbon fiber bundle that is easy to handle, wherein the sizing agent on the carbon fiber bundle is thermally degradable at a low temperature at which thermal degradation of oxygen-containing functional groups on the carbon fiber surface is prevented from occurring, resulting in a reduced void volume in carbon fiber-reinforced composites and the surface properties of the original carbon fibers being reflected on a matrix resin. Thermoplastic resin composites manufactured by using the present invention are light in weight and high in strength and therefore suitable for use in many fields, such as aircraft parts, spacecraft parts, automobile parts, marine parts, construction materials, and sports goods.

The invention claimed is:

1. A carbon fiber bundle comprising carbon fibers and a sizing agent that satisfies all of the following requirements (i) to (iv), and wherein a surface oxygen concentration of the carbon fiber is not less than 0.11 and not more than 0.25 as measured by X-ray photoelectron spectroscopy before the sizing agent is applied to the carbon fibers:

(i) the sizing agent satisfies the requirement (a) or (b):

(a) the percentage by mass of a polyalkylene glycol structure in the total sizing agent is not less than 80% by mass and the number-average molecular weight of the sizing agent is not less than 120 and less than 300;

(b) the sizing agent has an acetylene structure and the percentage by mass of the polyalkylene glycol structure in the total sizing agent is not less than 20% by mass;

(ii) the thermal weight loss ratio A determined under the following measurement conditions is not more than 5.0%;

(iii) the thermal weight loss ratio B determined under the following measurement conditions is not less than 11.0%;

(iv) the thermal weight loss ratio C determined under the following measurement conditions is not less than 90.0%:

<thermal weight loss ratio A> the sizing agent weighing 10±2 mg (the weighed mass is represented by $W_{A0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 140° C. (the measured mass is represented by $W_{A1}$ (mg)), and the thermal weight loss ratio A is calculated by the following formula (A):

$$\text{thermal weight loss ratio } A\,(\%) = \{(W_{A0} - W_{A1})/W_{A0}\} \times 100; \quad \text{(A)}$$

<thermal weight loss ratio B> the sizing agent weighing 10±2 mg (the weighed mass is represented by $W_{B0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 250° C. (the measured mass is represented by $W_{B1}$ (mg)), and the thermal weight loss ratio B is calculated by the following formula (B):

$$\text{thermal weight loss ratio } B\,(\%) = \{(W_{B0} - W_{B1})/W_{B0}\} \times 100; \quad \text{(B)}$$

<thermal weight loss ratio C> the sizing agent weighing 10±2 mg (the weighed mass is represented by $W_{C0}$ (mg)) is heated from 30° C. at a rate of 10° C./min with nitrogen gas flow of 200 milliliters (the volume is that under 1 atm at 25° C.) per minute by using thermogravimetry to measure the mass of the sizing agent when it has reached 350° C. (the measured mass is represented by $W_{C1}$ (mg)), and the thermal weight loss ratio C is calculated by the following formula (C):

$$\text{thermal weight loss ratio } C\,(\%) = \{(W_{C0} - W_{C1})/W_{C0}\} \times 100. \quad \text{(C)}$$

2. The carbon fiber bundle of claim 1, wherein, in the case of (b), the number-average molecular weight of the sizing agent is not less than 120 and less than 300.

3. The carbon fiber bundle of claim 1, wherein the sizing agent is substantially free of an aromatic ring.

4. The carbon fiber bundle of claim 1, wherein the sizing agent content is not less than 0.3% by mass and not more than 1.2% by mass.

5. The carbon fiber bundle of claim 1, wherein the carbon fibers have a bundle-bundle friction coefficient of not less than 0.25 and not more than 0.43 before the sizing agent is applied.

6. A method of producing the carbon fiber bundle of claim 1, the method comprising the steps of: applying the sizing agent to the carbon fibers; and drying the bundle of carbon fibers coated with the sizing agent after the applying step.

7. The method of claim 6 for producing the carbon fiber bundle, wherein the drying process comprises drying the carbon fiber bundle at a temperature of 110 to 140° C.

* * * * *